US005407168A

United States Patent [19]

Shultz

[11] Patent Number: 5,407,168

[45] Date of Patent: Apr. 18, 1995

[54] STAND FOR TREES AND OTHER CYLINDRICAL OBJECTS

[76] Inventor: Jerry L. Shultz, 39685 Howard Rd., Marcola, Oreg. 97454

[21] Appl. No.: 189,598

[22] Filed: Jan. 31, 1994

[51] Int. Cl.[6] ..... F16M 13/00

[52] U.S. Cl. ..... 248/526; 248/519

[58] Field of Search ..... 248/519, 526, 529, 514, 248/523, 188.7; 47/40.5

[56] References Cited

U.S. PATENT DOCUMENTS

| | | | |
|---|---|---|---|
| 357,792 | 2/1887 | Smith | 248/526 X |
| 1,198,694 | 9/1916 | Bargmann | 248/523 |
| 1,273,639 | 7/1918 | Lyons | 248/526 |
| 1,445,625 | 2/1923 | Junkunc | 248/523 |
| 1,811,918 | 6/1931 | Danner | 248/526 X |
| 2,630,286 | 3/1953 | Dieckhoff | 248/523 |
| 3,045,959 | 7/1962 | Herrington | 248/526 |
| 3,295,802 | 1/1967 | Leatherman | 248/529 |
| 3,697,026 | 10/1972 | Hambrick | 248/529 |
| 4,088,294 | 5/1978 | Aliment et al. | 248/519 |
| 4,254,578 | 3/1981 | Hanfeld | 47/40.5 |
| 4,676,471 | 6/1987 | Moore | 248/526 |
| 4,796,382 | 1/1989 | Anderson | 47/40.5 |

FOREIGN PATENT DOCUMENTS

| | | | |
|---|---|---|---|
| 182047 | 2/1918 | Canada | 248/523 |

*Primary Examiner*—Karen J. Chotkowski

[57] ABSTRACT

A portable, collapsible stand for supporting a cut tree or other generally cylindrical object in a vertical orientation, comprising a plurality of formed leg pair members (14) connected at their centers and radially arrayed to form a central, vertically oriented chamber (32) into which the object is placed. The weight of the object forces the chamber downwards causing the upper extremes (18,24) of the chamber to grasp the object by a spring force. This chamber is then clamped circumferentially to the object for stability. Means for adjusting the apparent vertical orientation of the supported object operate by changing the angle of the leg sections (12,28) and simultaneously tilting the vertically oriented chamber (32) in the required direction.

6 Claims, 4 Drawing Sheets

STAND FOR TREES AND OTHER CYLINDRICAL OBJECTS

BACKGROUND OF THE INVENTION

1. Field of the Invention

This invention relates to stands and supports for cut trees and other generally cylindrical objects.

2. Description of the Prior Art

Stands and supports for cut trees, especially Christmas trees, and other generally cylindrical objects is a crowded art. A myriad of designs are extant, none of which addresses simultaneously all the reasonable requirements of stability, ease of assembly, ease of use, safety in application, durability, ease and cost of manufacture, appealing appearance, and convenient storage.

In a relatively stable stand such as U.S. Pat. No. 3,697,026 to Hambrick (1971) we find a complex assemblage of components that does not appear to be easy to manufacture or use. In a design such as U.S. Pat. No. 4,796,382 to Anderson (1989) we find only the appearance of simplicity, the stand having multiply braced legs connected by pins to a formed bowl, an inadequate quantity of water to obviate frequent attention, no effective means for adjusting the vertically plumb orientation of the object supported, and poor storage characteristics. In U.S. Pat. No. 4,254,578 to Hanfeld (1981) we see again a relatively complex manufacture relying on tilting of the entire base assembly to adjust for vertical orientation, which compromises stability. In U.S. Pat. No. 4,676,471 to Moore (1987) we find a complex assemblage of parts, virtually no water reservoir capacity to keep a cut tree from becoming a fire hazard, and no adjustment for tilt. A simple design found in U.S. Pat. No. 3,295,802 to Leatherman (1967) requires the separate attachment of three parts to the object supported and makes no provision for adjusting the vertical orientation of less than perfectly straight cylinders or tree trunks.

SUMMARY OF THE INVENTION

The subject invention is a collapsible device for securely supporting in a vertical orientation a Christmas tree or other approximately cylindrical object, using individually formed leg pair members. Each leg pair member consists of a foot section, a reinforced leg section rising diagonally from the foot section to an acute bend at a topmost point of the member, continuing from this bend essentially vertically downward to a 180° semicircular bend, continuing then vertically upward to an acute bend at a second topmost point, a second reinforced leg section further continuing diagonally downward to a second foot section at the opposite end of the member from the first. Two or more such leg pair members, when attached to each other at a point central to their length by a fastener through a hole central to the length of each and arrayed radially and symmetrically from this point, form a stable stand which incorporates a central, vertically oriented chamber which receives the object to be supported. Under a no load condition, this central chamber is suspended above the horizontal surface. The hemispherical shape of the bottom of this chamber centers the object in the vertically oriented chamber. The mass of the object forces the chamber section downward toward the horizontal surface, causing the upper portions of the vertical sections of the leg pair members to grasp the object placed in the chamber by a spring force which closes them about the circumference of the object. The vertical section of the chamber formed by the leg pair members can then be secured to the object circumferentially to lock the object in place with any of several well known clamping means. In the case of a cut Christmas tree, the tree may then be suspended in the vertically oriented chamber inside a container which can contain a liquid to prevent drying of the tree. Adjusting means are provided to allow changing the apparent vertical orientation of the supported object, by simultaneously (a) changing the angle between the diagonally descending leg section and the vertical section of the leg pair member and (b) tilting the entire vertically oriented chamber slightly off true vertical in the required direction.

OBJECTS OF THE INVENTION

Accordingly, several objects and advantages of the present invention are as follows:

a) to provide a stand consisting of a minimum number of easily fabricated parts;

b) to provide a stand which has superior characteristics of stability;

c) to provide a stand which requires no assembly by the user;

d) to provide a stand which automatically centers and grasps the object supported in the receiving vertically oriented chamber, ready for securing;

e) to provide a stand which adjusts without user intervention to a wide range of object diameters;

f) to provide a stand which allows securing of the supported object with a single action, the tightening of a clamping means;

g) to provide a stand which requires no drilling, nailing, or attaching of screws or guys to the supported object to secure it in place;

h) to provide a stand which allows a supported cut tree to be suspended inside a container of liquid;

i) to provide a stand which allows reasonable adjustment of the apparent vertical orientation of the supported object without compromising stability; and j) to provide a stand which collapses to a conveniently stored size between uses.

Further objects and advantages of the present invention are to provide a stand which is durable, inexpensive to manufacture, and attractive in design. Still further objects and advantages will become apparent from the following detailed description and accompanying drawings.

DRAWING FIGURES

Figure 2:
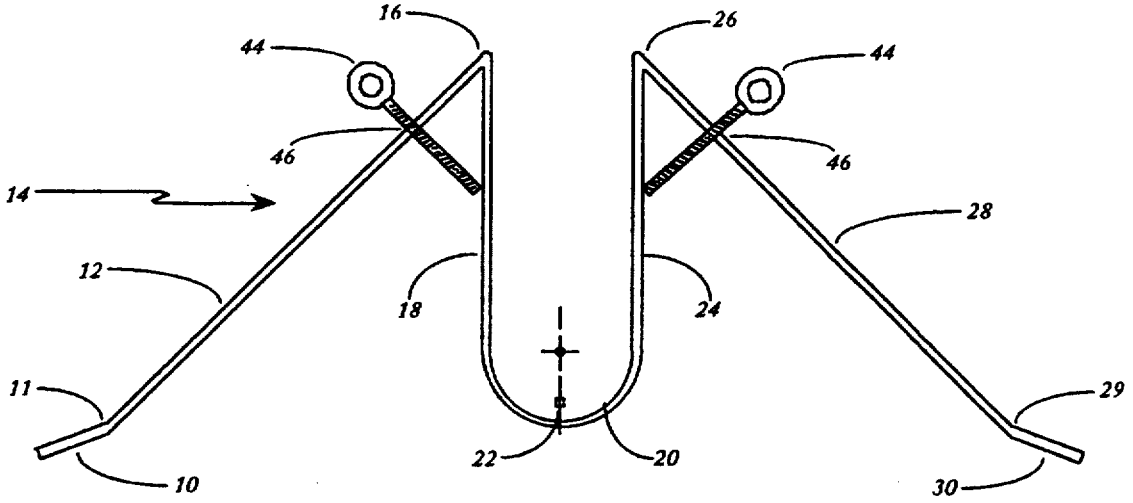
FIG. 2 is an elevational view of a single leg pair member of a preferred embodiment.
Figure 2A:
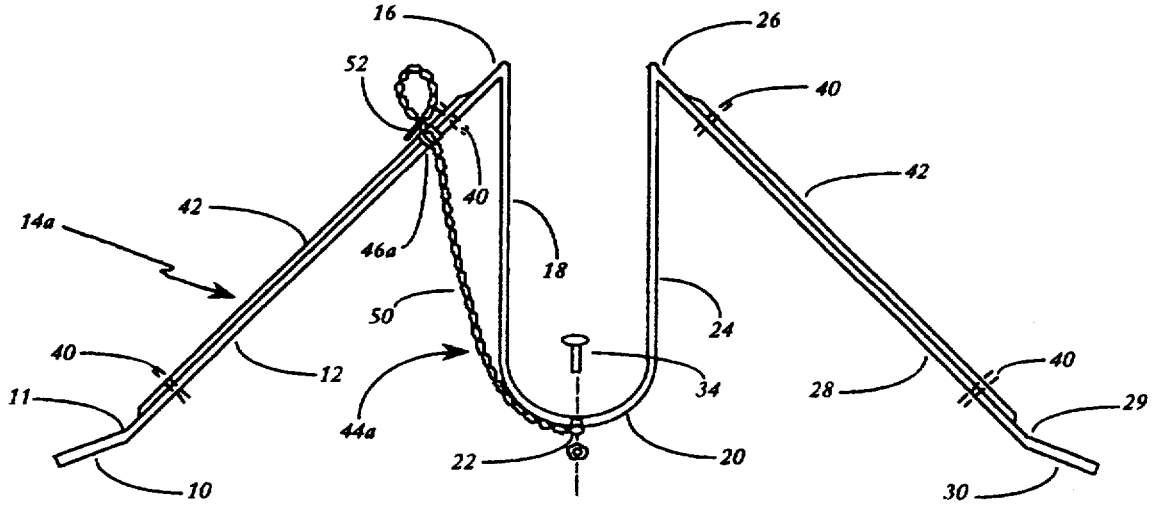

FIG. 2*a* is an elevational view of a single leg pair member showing an alternative reinforcing means for the leg section and alternative adjusting means.

Figure 3:
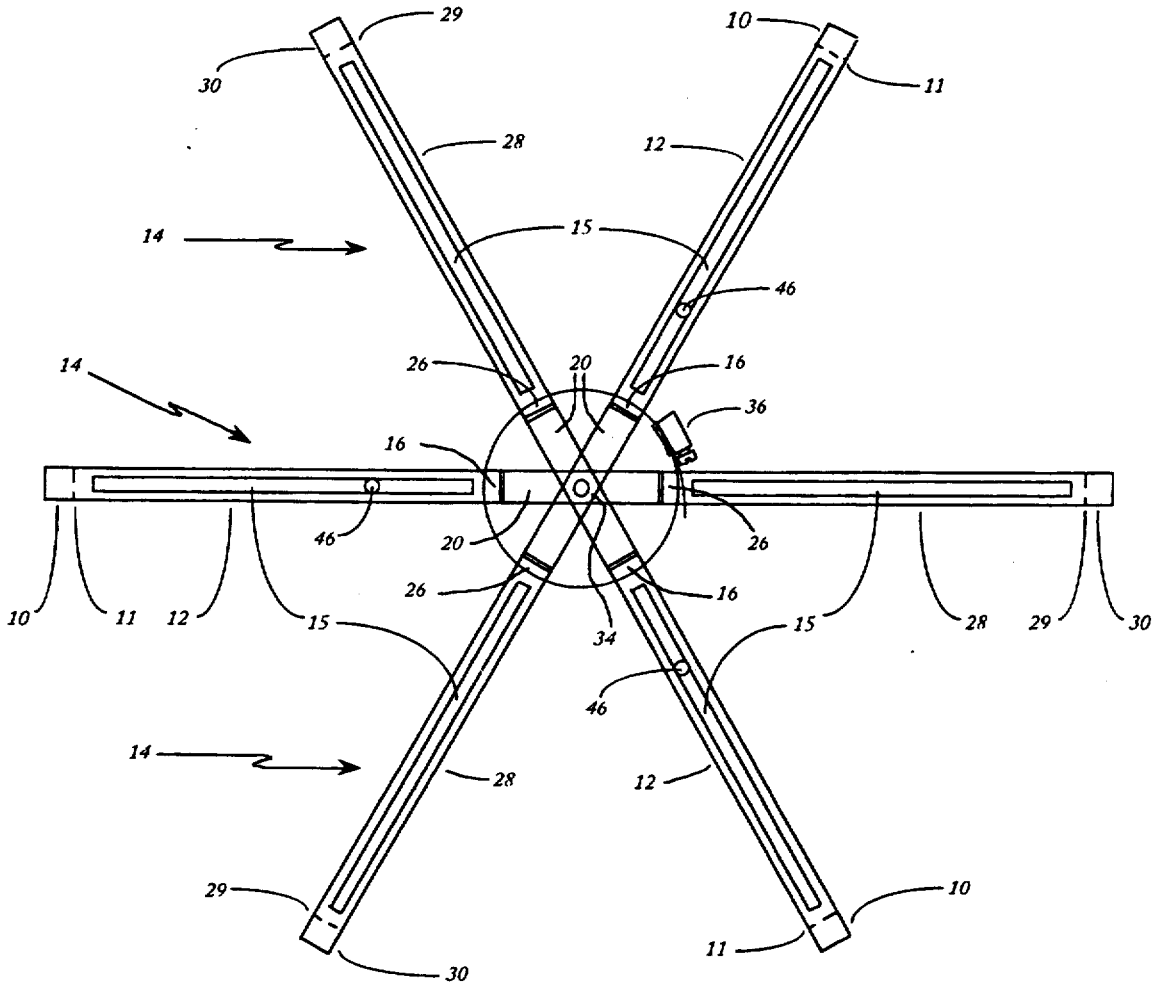

FIG. 3 is a top plan view of a preferred embodiment.

Figure 4:
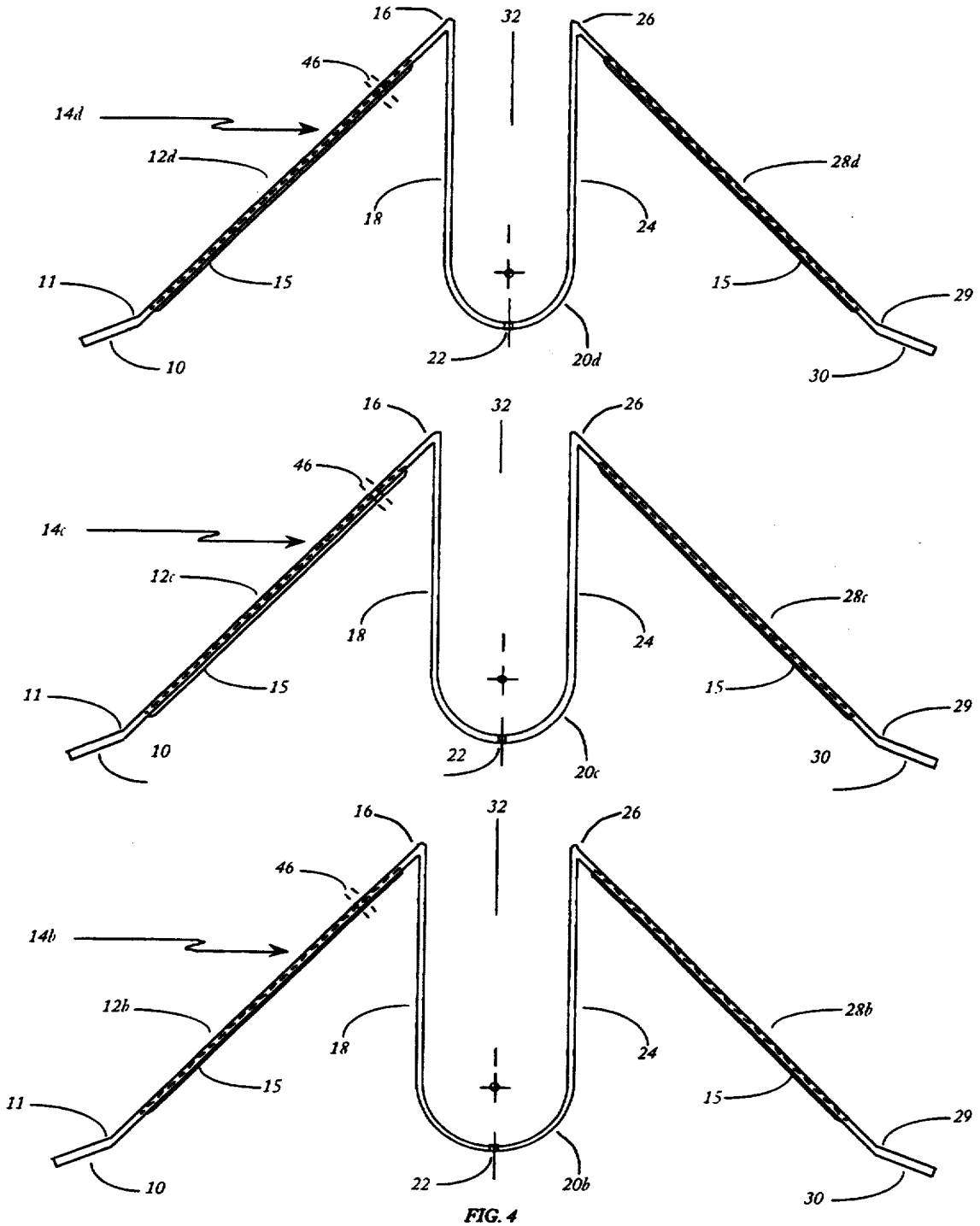

FIG. 4 is an elevational view of separated leg pair elements showing minor modifications contributing to a second preferred embodiment.

Reference Numerals Used in Drawings

10—first foot section

11—first foot section bend

12—reinforced ascending leg section

12*b, c, d*—modified leg sections

14—leg pair member
14*a, b, c, d*—modified leg pair member
15—longitudinal embossment
16—first acute bend
18—descending vertical section
20—180° bend
20*b, c, d*—modified 180° bends
22—central hole
24—ascending vertical section
26—second acute bend
28—reinforced descending leg section
28*b, c, d*—modified leg sections
29—second foot section bend
30—second foot section
32—vertically oriented chamber
34—fastener
36—typical clamping means
40—reinforcement hole
42—reinforcing rib
44—adjusting means
44*a*—alternative adjusting means
46—threaded hole
46*a*—alternative adjusting hole
50—chain
52—pin

DESCRIPTION OF THE PREFERRED EMBODIMENTS

Figure 1:
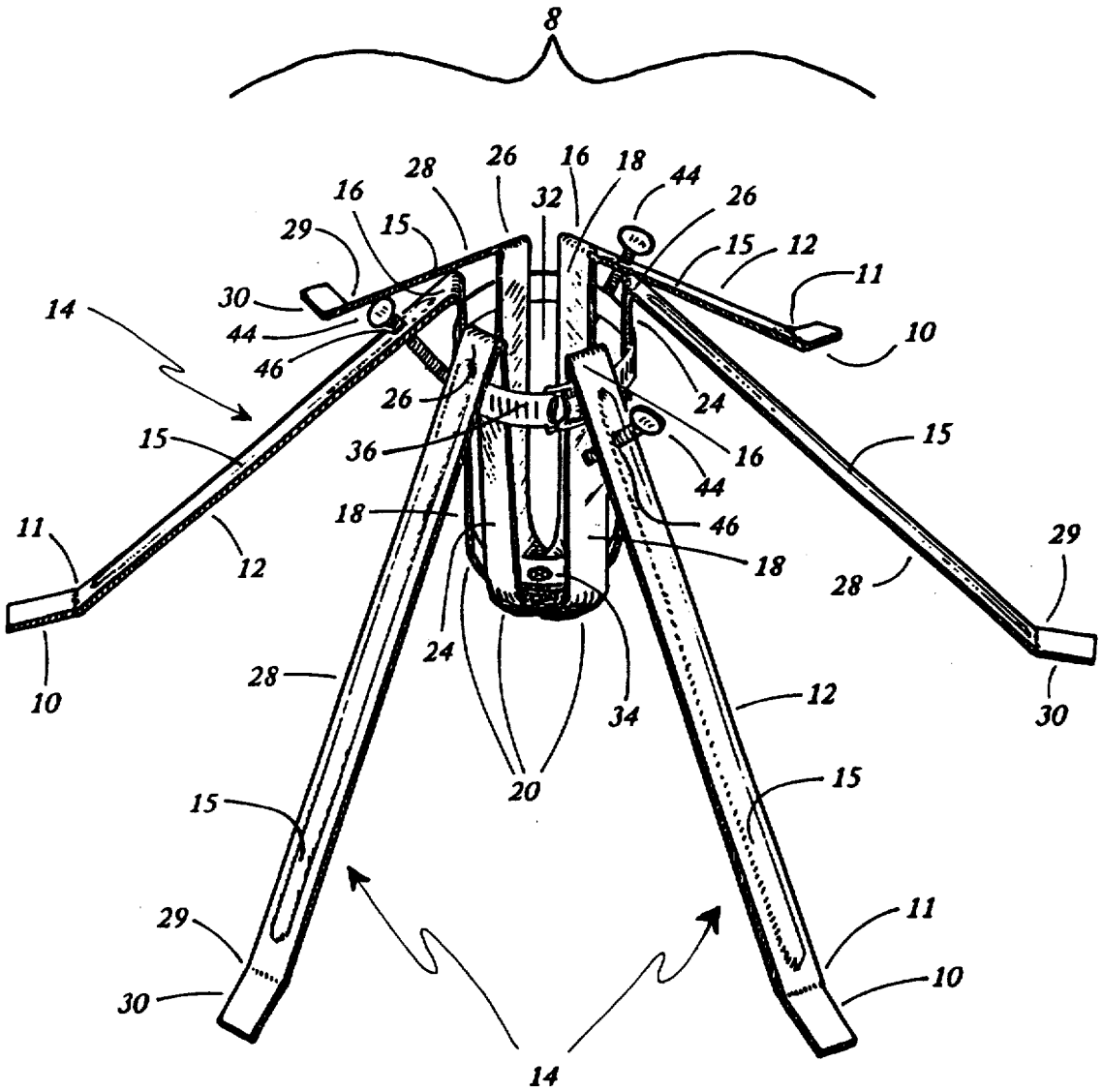
FIG. 1 is a perspective view of a preferred embodiment of the present invention ready for use.

Referring now to FIGS. 1, 2, and 3, a preferred embodiment of the present invention shows a stand generally designated as 8 in FIG. 1 for supporting a cut tree or other generally cylindrical object in a vertical orientation on a floor or other horizontal surface. Stand 8 includes a plurality of longitudinally oriented, bilaterally symmetrical leg pair members 14 formed of flat metal bar comprising a first foot section 10 which rests on a horizontal surface, continues from first foot section 10 by an obtuse first foot section bend 11 into a reinforced ascending leg section 12 rising diagonally to a first acute bend 16. Leg sections 12 and 28 are reinforced in a preferred embodiment by a longitudinal embossment 15 which runs the length of leg sections 12 and 28 from the bends 11 and 29 at the proximal ends of foot sections 10 and 30 nearly to acute bends 16 and 26. Turning specifically to FIGS. 1 and 2, continuing from first acute bend 16 is a descending vertical section 18 terminating in a 180° semicircular bend 20. At the center point of the arc segment forming 180° bend 20 is found a central connecting hole 22 for fastening together a plurality of leg pair members 14. Central hole 22 is located at the mid point of the material forming leg pair member 14. Further continuing from 180° bend 20 is an ascending vertical section 24, equal in length to descending vertical section 18, which rises to a second acute bend 26, then to a reinforced diagonally descending leg section 28 and finally to a second obtuse bend 29 at the proximal end of a second foot section 30.

From FIG. 2 it is clear that leg pair member 14 may be formed in a single pressing or forming operation which imparts bends 11, 16, 20, 26, 29, and embossments 15 to a length of the material of construction.

It is also clear that leg pair member 14 may be formed from an assemblage of component sections welded or bolted together.

Referring now to FIGS. 1 and 2, in a preferred embodiment a threaded adjusting means 44 is incorporated into each leg pair member 14 through a threaded hole 46 found in the upper one third of ascending leg section 12.

The stand 8 is assembled by attaching two or more leg pair members 14 together by a fastener 34 passing through central hole 22 of each; then by inserting adjusting means 44 into threaded holes 46 in each. When three leg pair members 14 are used, members 14 are assembled in such an order that adjusting means 44 are found on alternate radially arrayed leg sections 12 when the assemblage of members 14 are deployed into a radially symmetrical circular array, thus giving three radially equidistant axes for adjustment. When only two leg pair members 14 are used, it is necessary to provide an additional adjusting means 44 at each leg section 28 as shown in FIG. 2 in order to allow a full range of adjustment for vertical orientation. Assembly is completed by sliding a clamping means shown in FIGS. 1 and 3 as 36 over the exterior of a vertically oriented chamber 32 formed by the assemblage toward acute bends 16 and 26 of each included leg pair member. As illustrated in FIG. 1 it is desirable to slide clamping means 36 as far as possible toward acute bends 16 and 26 in order to increase the rigidity of vertically oriented chamber 32 when securing the object supported in stand 8.

FIG. 2*a* shows a modification of leg pair member 14, designated here as 14*a*, where reinforcement is accomplished by the addition of a reinforcing rib 42 to ascending leg section 12 and descending leg section 28. Reinforcing rib 42 is attached respectively to leg sections 12 and 28 by any suitable fasteners. FIG. 2*a* also shows an alternative adjusting means 44*a* consisting of a length of inelastic material attached to fastener 34 at one extreme and extending obliquely upward to a hole in the upper one-third of ascending leg section 12 where it can be secured by any suitable means under tension to impart a tilt to vertically oriented chamber 32. In FIG. 2*a*, for example, alternative adjusting means 44*a* is shown as a length of lightweight chain 50 secured by fastener 34 at one end. The chain passes through a hole 46*a* in the upper one-third of ascending leg section 12 and is secured on the distal face of leg section 12 by a pin 52 passing through the appropriate link to impart the required tension to tilt vertically oriented chamber 32 as needed to adjust the vertical orientation of the object supported.

FIG. 4 is an elevational view of three separated leg pair members 14*b*, 14*c*, and 14*d* showing minor modifications contributing to a second preferred embodiment. These modifications consist of sizing the dimensions of 180° bends 20*b*, 20*c*, and 20*d* and the respective corresponding leg sections 12*b* and 28*b*, 12*c* and 28*c*, and 12*d* and 28*d*, such that the leg pair members nest one inside the other for storage, yet still open radially with their several respective foot sections 10 and 30 in coplanar alignment for use. For example, for leg pair member 14*c* to nest with member 14*b*, the diameter of 180° bend 20*c* must be reduced by 2× the thickness of the material of construction. The resulting decrease in the circumference of bend 20*c* must be compensated by increasing the length of 12*c* and 28*c* each by one-half of this value. For leg pair member 14*d* to nest with member 14*c*, the diameter of bend 20*d* must be reduced by 4× the thickness of the material with respect to bend 20*b*, and the length of leg sections 12*d* and 28*d* each increased by one-half of this new value.

OPERATION OF THE INVENTION

The present invention is made ready for use by spreading assembled leg pair members 14 into a symmetrical circular array and placing a clamping means, shown typically in FIGS. 1 and 3 as 36, around vertically oriented chamber 32. The deployed stand 8 is now placed on the supporting surface in an upright position such that first and second foot sections 10 and 30 of all leg pair members 14 rest on the surface. As seen in FIG. 1, not yet under any load, the bottom of chamber 32 rests above the supporting surface. The lower extreme of the object to be supported is introduced into the opening of vertically oriented chamber 32 and allowed to descend into chamber 32 as far as possible. The hemispherical shape of the closed end of chamber 32 causes the object to be automatically centered in chamber 32, and the mass of the object forces chamber 32 downward toward the supporting surface. This causes the upper portions of vertical sections 18 and 24 of each leg pair member 14 to close about the circumference of the inserted object until in close contact with its longitudinal surface. Reinforcing embossments 15 on leg sections 12 and 28 resist bending forces on leg sections 12 and 28 while still allowing some resiliency at acute bends 16 and 26 to absorb shock loads and allow for adjustment. Clamping means 36 is now tightened about the circumference of chamber 32 as close to the upper end of chamber 32 as possible, locking the object supported firmly in place.

Should the user wish to adjust the apparent vertical orientation of the object, adjusting means 44 as shown in FIGS. 1 and 2 provide together axes of adjustment in an assembled stand 8, acting as follows: as a single adjusting means 44 is turned inward toward chamber 32 the angle of acute bend 16 is opened slightly while the bottom of chamber 32 is simultaneously forced away from subject adjusting means 44. Both reactions cause the supported object to lean in the direction of adjusting means 44. It can thus be seen that by variously adjusting in concert adjusting means 44 the user can easily make any reasonably chosen cut tree or other object stand in apparent vertical orientation.

Regarding alternative adjusting means **44*a* as shown in FIG. 2*a*, adjustment for vertical orientation is accomplished by pulling chain 50 through hole 46*a* in the upper one-third of leg section 12 and securing chain 50 by passing pin 52 through an appropriate link to render chain 50 under the desired tension. This action results in the angle at acute bend 16 closing slightly while the bottom of chamber 32 is pulled toward subject adjusting means 44*a*. Both reactions cause the object supported to lean away from subject adjusting means 44*a*. Again it can be seen that by variously adjusting in concert adjusting means 44*a*** the user can easily make any reasonably chosen cut tree or other object stand in apparent vertical orientation.

Referring now to FIG. 4, leg pair members **14*b*, 14*c*, and 14*d*, when assembled, function exactly as the plurality of leg pair members 14 comprising stand 8 described above and in FIGS. 1, 2, and 3, with the exception that leg pair members 14*b*, 14*c*, and 14*d* collapse completely to nest into one another, while leg pair members 14 of the first preferred embodiment as shown in FIGS. 1 and 3** collapse only partially for storage.

CONCLUSIONS, RAMIFICATIONS, AND SCOPE OF THE INVENTION

Thus the reader will see that stand of the invention provides a supporting device which has superior stability, is easier to use than other available models, consists of only a few easily fabricated parts, adjusts to and automatically centers supported objects of a wide range of diameters, and stores compactly. In addition, when used to support a cut tree, the stand makes allowance for an ample liquid supply to prevent drying of the tree, and allows easy adjustment of the tree for apparent vertical orientation.

While the above description covers two preferred embodiments and variants of important parts, many other variations are possible. For example, the material of construction could be round or square tubing, brass, copper, aluminum, or injection molded plastic. Accordingly, the above description should be considered illustrative only and not restrictive, the scope of the invention being indicated by the appended claims and their legal equivalents.

What I claim is:

1. A stand for cut trees and other generally cylindrical objects comprising:

a) a plurality of longitudinally oriented, bilaterally symmetrical leg pair members, each comprising:
   1) a first foot section which rests upon a horizontal surface;
   2) a first obtuse bend preceding a reinforced ascending leg section rising diagonally to a first acute bend;
   3) a descending vertical section extending from said first acute bend and leading to a 180° semicircular bend; said 180° semicircular bend having a central connecting hole at the center point of the arc segment;
   4) an ascending vertical section equal in length to said descending vertical section which rises from said 180° semicircular bend to a second acute bend;
   5) a reinforced diagonally descending leg section extending from said second acute bend; and
   6) a second obtuse bend extending to a second foot section which rests on the same horizontal surface as said first foot section;

b) a fastening means for connecting a plurality of said leg pair members together through said central connecting holes such that the assembled leg pair members, when deployed into a radially symmetrical circular array, form a vertically oriented chamber with a closed hemispherically shaped bottom for receiving the cut tree or object to be supported; and c) a clamping means for securing the cut tree or object supported in said stand.

2. A stand for cut trees and other generally cylindrical objects comprising:

a) a plurality of longitudinally oriented, bilaterally symmetrical leg pair members, each comprising:
   1) a first foot section which rests upon a horizontal surface;
   2) a first obtuse bend preceding a reinforced ascending leg section rising diagonally to a first acute bend;
   3) a descending vertical section extending from said first acute bend and leading to a 180° semicircular bend; said 180° semicircular bend having a central connecting hole at the center point of the arc segment;

4) an ascending vertical section equal in length to said descending vertical section which rises from said 180° semicircular bend to a second acute bend;

5) a reinforced diagonally descending leg section extending from said second acute bend; and 6) a second obtuse bend extending to a second foot section which rests on the same horizontal surface as said first foot section;

b) a fastening means for connecting a plurality of said leg pair members together through said central connecting holes such that the assembled leg pair members, when deployed into a radially symmetrical circular array, form a vertically oriented chamber with a closed hemispherically shaped bottom for receiving the cut tree or object to be supported, the assemblage incorporating adjusting means located in the upper one third of said ascending and descending leg sections and which means in combination adjust the apparent vertical orientation of the cut tree or object supported by simultaneously altering the angle of the respective adjacent acute bends and imparting a tilt to said vertically oriented chamber; and c) a clamping means for securing the cut tree or object supported in said stand.

3. The stand as defined in claims 1 and 2, wherein each said leg pair member is formed of a single continuous length of material when completed.

4. The stand as defined in claims 1 and 2, wherein each leg pair member comprises an assemblage of component sections.

5. The stand as defined in claims 1 and 2, wherein reinforcing of said ascending and descending leg sections is by a longitudinal embossment.

6. The stand as defined in claims 1 and 2, wherein reinforcing of said ascending and descending leg sections is by the attachment of a reinforcing rib to said leg sections along a face of their longitudinal axis by any suitable fasteners.

* * * * *